US006696946B2

(12) United States Patent
Iwasawa et al.

(10) Patent No.: US 6,696,946 B2
(45) Date of Patent: Feb. 24, 2004

(54) ANTI-THIEF SECURITY SENSOR ASSEMBLY

(75) Inventors: Masashi Iwasawa, Otsu (JP); Hiroyuki Ikeda, Otsu (JP)

(73) Assignee: Optex Co., Inc., Shiga (JP)

( * ) Notice: Subject to any disclaimer, the term of this patent is extended or adjusted under 35 U.S.C. 154(b) by 0 days.

(21) Appl. No.: 10/245,043

(22) Filed: Sep. 17, 2002

(65) Prior Publication Data

US 2003/0052781 A1 Mar. 20, 2003

(30) Foreign Application Priority Data

Sep. 19, 2001 (JP) ..... 2001-284608

(51) Int. Cl.[7] ..... G08B 13/00
(52) U.S. Cl. ..... 340/541; 340/545.3; 340/687
(58) Field of Search ..... 340/541, 545.3, 340/545.6, 550, 552, 556, 557, 565, 686.1, 687

(56) References Cited

U.S. PATENT DOCUMENTS 3,752,978 A * 8/1973 Kahl, Jr. et al. ..... 250/340
5,334,972 A * 8/1994 Sugimoto et al. ..... 340/556
5,596,310 A 1/1997 Itoh ..... 340/331
5,812,058 A * 9/1998 Sugimoto et al. ..... 340/556
6,411,215 B1 * 6/2002 Shnier ..... 340/686.1

FOREIGN PATENT DOCUMENTS

| | | |
|---|---|---|
| EP | 466 522 | 7/1991 |
| JP | 6044468 | 2/1994 |
| JP | 6076176 | 3/1994 |

* cited by examiner

*Primary Examiner*—Toan N Pham

(57) ABSTRACT

An anti-thief security sensor assembly wherein the alignment of the respective optical axes of the beam projecting unit and receiving unit with each other can be performed continuously over a required length of time is provided which includes a beam projecting unit (1) for emitting an infrared beam (IR), and a beam receiving unit (2) for receiving the infrared beam (IR) emitted from the beam projecting unit (1). The beam projecting unit (1) includes a first switch (16) adapted to be activated when a cover (10) protecting the beam projecting unit (1) is removed and for outputting a discriminative signal (B) descriptive of removal of such cover, and a transmitting circuit (17) for transmitting the discriminative signal (B) from the beam projecting unit (1) to the beam receiving unit (2), and a recognizing circuit (28) for receiving the discriminative signal (B) and outputting a notifying signal necessary to generate an alarm indicative of the removal of the cover (10).

11 Claims, 2 Drawing Sheets

ANTI-THIEF SECURITY SENSOR ASSEMBLY

BACKGROUND OF THE INVENTION

1. Field of the Invention

The present invention generally relates to an anti-thief security sensor assembly and, more particularly, to the anti-thief security sensor assembly of a type wherein while an infrared beam emitted from a beam projecting unit is constantly received by a beam receiving unit, an alarm is generated when an unauthorized intruder traverses across the path of travel of the infrared beam from the beam projecting unit towards the beam receiving unit.

2. Description of the Prior Art

The anti-thief security sensor assembly is known in which a beam projecting unit and a beam receiving unit are installed spaced an appropriate distance from each other with their optical axes aligned with each other as to minimize stray lights, which are reflected from wall surfaces and/or ground surfaces out of the intended path, so that the capability of the sensor assembly to detect passage of an unauthorized intruder can be increased. However, with increase of the distance between the beam projecting unit and the beam receiving unit, alignment of the respective optical axes of the beam projecting unit and the beam receiving unit becomes difficult to achieve, requiring a relatively long time to complete. An exemplary type of the conventional anti-thief security sensor assembly is generally of a design in which when a cover used to protect front regions of the beam projecting unit and receiving unit is removed to detect interference with the detecting operation, light projecting and receiving operations are halted to emit an alarm.

For this reason, during performance of the alignment of the respective optical axes between the beam projecting unit and receiving unit with the cover removed, a timer is manually activated by a servicing person and, during the counting of time performed by the activated timer, the beam projecting and receiving operations are continued even though the cover has been removed, so that the infrared beam can be emitted to facilitate the alignment between the respective optical axes of the beam projecting unit and receiving unit. However, the structure of the conventional anti-thief security sensor assembly in which the infrared beam is emitted only during the counting operation performed by the timer tends force the servicing person to be constantly under pressure that the job of optical alignment must be finished within a predetermined length of time set in the timer and, therefore, it is often experienced that poorly accurate alignment is achieved.

Also, with increase of the distance between the beam projecting unit and the beam receiving unit, alignment of the respective optical axes of the beam projecting unit and the beam receiving unit becomes difficult to achieve, requiring a relatively long time to complete. Specifically, since emission of the infrared beam from the beam projecting unit is halted at the moment the timer counts up, an additional job is required to set the timer on again to allow the beam projecting unit to emit the infrared beam so that the servicing person can continue the alignment job. Accordingly, the alignment job is required to interrupt for a moment, thereby resulting in a loss of contiguity of the alignment job. This in turn brings about reduction in work efficiency and also reduction in alignment accuracy.

SUMMARY OF THE INVENTION

In view of the foregoing, the present invention is intended to provide an anti-thief security sensor assembly wherein the alignment of the respective optical axes of the beam projecting unit and receiving unit can be performed continuously over a required length of time.

To this end, the present invention according to one aspect thereof provides an anti-thief security sensor assembly of a type including a beam projecting unit for emitting an infrared beam, and a beam receiving unit for receiving the infrared beam emitted from the beam projecting unit, wherein when a human body or the like intercepts passage of the infrared beam traveling from the beam projecting unit towards the beam receiving unit, the human body or the like can be detected. This anti-thief security sensor assembly also includes a first switch adapted to be activated when a cover protecting the beam projecting unit is removed and for outputting a discriminative signal descriptive of removal of such cover, a transmitting circuit for transmitting the discriminative signal from the beam projecting unit to the beam receiving unit, and a recognizing circuit provided in the beam receiving unit for receiving the discriminative signal and outputting a notifying signal necessary to notify the removal of the cover.

According to the above discussed aspect of the present invention, in the event that the cover protecting the beam projecting unit is removed, the first switch is activated to generate to the beam receiving unit a discriminative signal indicative of the removal of the cover from the beam projecting unit and emission of the infrared beam from the beam projecting unit continues. Accordingly, during performance of a job of aligning respective optical axes of the beam projecting unit and receiving unit with each other with the cover removed, a servicing person can concentrate on the alignment job without worrying about the length of time permitted to perform it and, hence, not only can the work efficiency of the alignment job be increased, but also the accuracy of the optical alignment can be increased.

Also, since the recognizing circuit provided in the beam receiving unit is operable in response to receipt of the discriminative signal to output the notifying signal indicative of the removal of the cover for the beam projecting unit and, therefore, the beam receiving unit can recognize the removal of the cover from the beam projecting unit to thereby trigger the alarm.

The present invention in accordance with another aspect thereof provides an anti-thief security sensor assembly of a type including a beam projecting unit for emitting an infrared beam, and a beam receiving unit for receiving the infrared beam emitted from the beam projecting unit, wherein when a human body or the like intercepts passage of the infrared beam traveling from the beam projecting unit towards the beam receiving unit, the human body or the like can be detected. This anti-thief security sensor assembly also includes a second switch adapted to be manually operated to output to the beam projecting unit a discriminative signal indicative of a job of aligning respective optical axes of the beam projecting unit and receiving unit with each other being performed, a transmitting circuit for transmitting the discriminative signal from the beam projecting unit to the beam receiving unit, and a recognizing circuit provided in the beam receiving unit for receiving the discriminative signal and outputting a notifying signal to notify the removal of the cover.

According to the second mentioned aspect of the present invention, when a servicing person removes the cover from the beam projecting unit preparatory to the optical alignment being performed and subsequently manipulates the second switch, a discriminative signal indicative of the removal of the cover from the beam projecting unit is outputted to the beam receiving unit and emission of the infrared beam from the beam projecting unit continues. Accordingly, during performance of a job of aligning respective optical axes of the beam projecting unit and receiving unit with each other with the cover removed, a servicing person can concentrate on the alignment job without worrying about the length of time permitted to perform it and, hence, not only can the work efficiency of the alignment job be increased, but also the accuracy of the optical alignment can be increased.

In one preferred embodiment of the present invention, the transmitting circuit referred to above may be operable to superimpose the discriminative signal on the infrared beam emitted from the beam projecting unit and, in such case, the recognizing circuit is operable to discriminate the discriminative signal from the infrared beam received by the beam receiving unit.

According to this preferred embodiment, the discriminative signal is supplied to the beam receiving unit having been superimposed on the infrared beam emitted from the beam projecting unit and the recognizing circuit in the beam receiving unit discriminates the discriminative signal. Accordingly, the anti-thief security sensor assembly of the present invention doe not require an extra use of a device solely for transmitting and receiving the discriminative signal and can therefore be simplified in structure.

BRIEF DESCRIPTION OF THE DRAWINGS

In any event, the present invention will become more clearly understood from the following description of preformed embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Preferred embodiments of the present invention will now be described with reference to the accompanying drawings.

Figure 1:
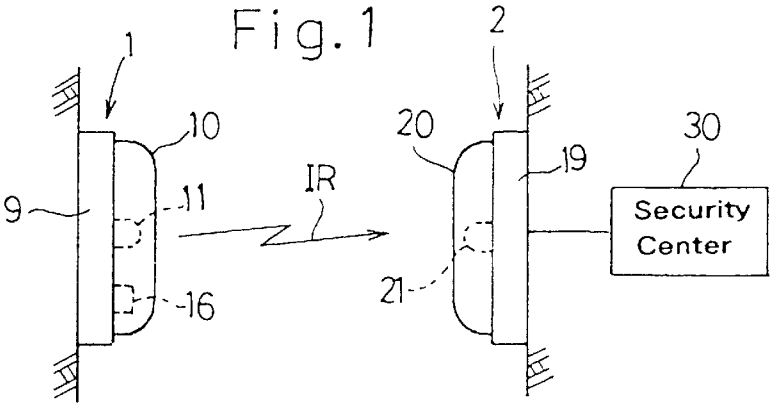
FIG. 1 is a schematic side view of an anti-thief security sensor assembly according to a first preferred embodiment of the present invention.

Referring first to FIG. 1, an anti-thief security sensor assembly embodying the present invention generally includes a beam projecting unit 1 for emitting an infrared beam IR and a beam receiving unit 2 for receiving the infrared beam IR emitted from the beam projecting unit 1. The beam projecting unit 1 has a projector base 9 adapted to be secured to a support surface such as, for example, a wall and a projector cover 10 for covering the projector base 9 and, similarly, the beam receiving unit 2 has a receiver base and a receiver cover 20 for covering the receiver base 19.

Figure 2:
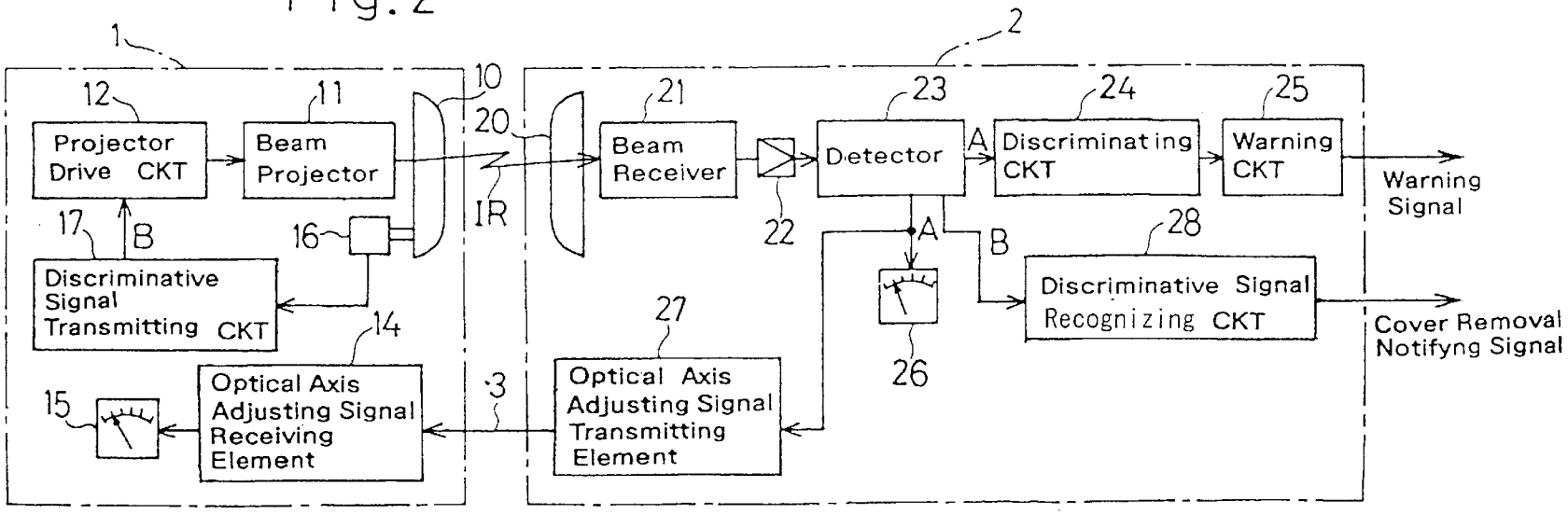
FIG. 2 is a circuit block diagram showing an electric circuit employed in the anti-thief security sensor assembly.
Figures 3A, 3B, 3C, 4:
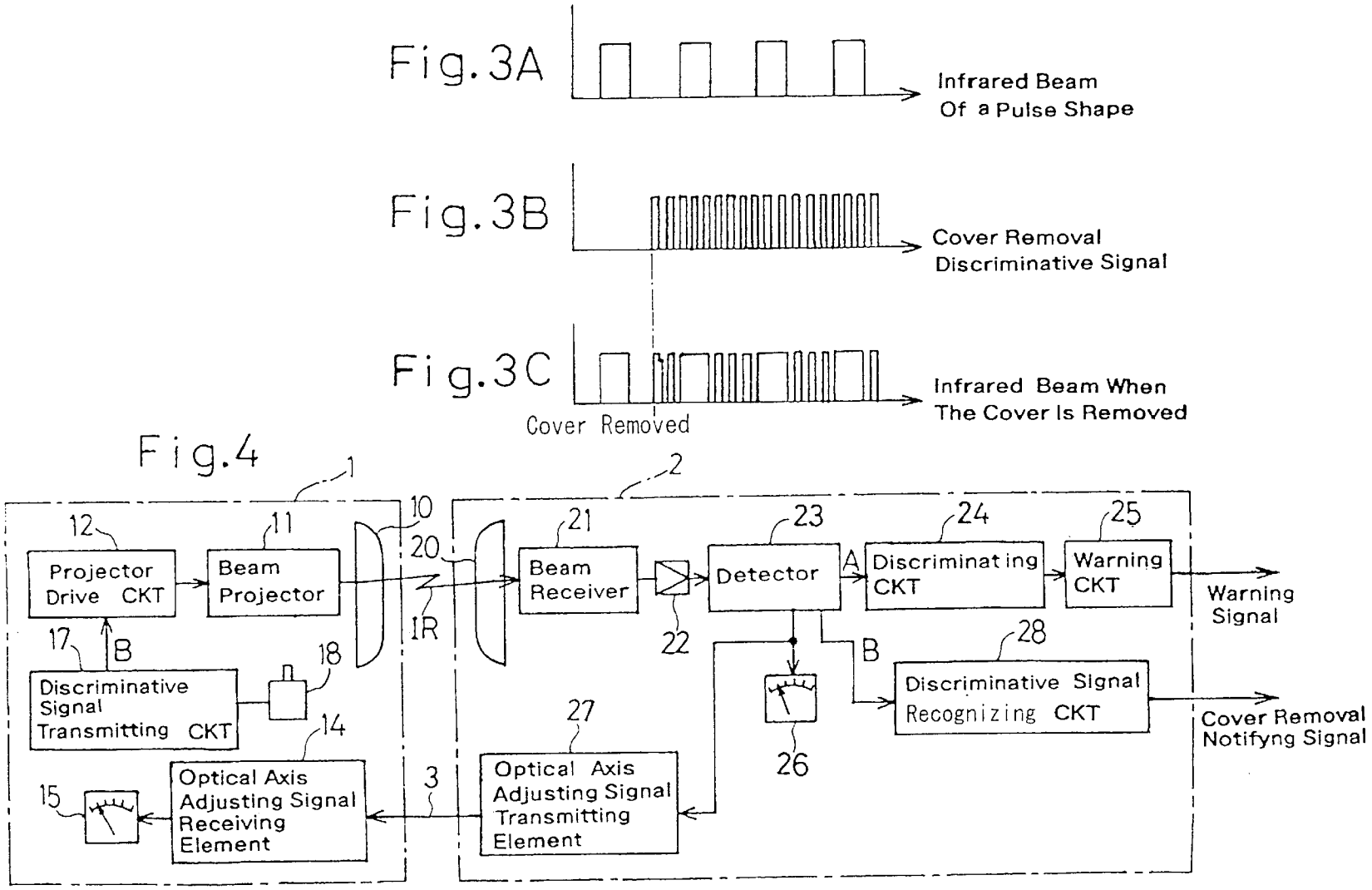
FIGS. 3A to 3C are waveforms of infrared beams and a discriminative signal employed in the circuit shown in FIG. 2.
FIG. 4 is a circuit block diagram showing an electric circuit employed in the anti-thief security sensor assembly according to a second preferred embodiment of the present invention.

A block circuit diagram of the anti-thief security sensor assembly according to a first preferred embodiment of the present invention is particularly shown in FIG. 2. A projector 11 of the beam projecting unit 1 and a receiver 21 of the beam receiving unit 2 are positioned at corresponding locations on respective sides of an area where an unauthorized intruder is to be detected, with their optical axes aligned with each other. The projector 11 is made up of a light emitting element (not shown) such as, for example, an infrared emitting diode, a transmitting optics such as, for example, a projector lens or a reflecting mirror, for forming an infrared beam IR to be projected, and an optical axis adjusting mechanism, such that when the light emitting element is driven by a projector drive circuit 12 at a predetermined frequency, the infrared beam IR in the form of a pulse modulated light as shown in FIG. 3A can be emitted through the projector cover 10 covering a front region of the projector 1. The projector base 9 shown in FIG. 1 has sensor circuit elements mounted thereon as will be described later, which sensor circuit elements are covered and protected by the projector cover 10.

On the other hand, the light receiver 21 of the beam receiving unit 2 is made up of a receiver optics (not shown) such as, for example, a light receiving lens or a light collecting mirror, a light receiver such as, for example, a photo-diode, and an optical axis adjusting mechanism, such that when the light receiver receives the infrared beam IR incident thereon through the receiver cover 20 covering and protecting a front region of the light receiver 2, the light receiver outputs an electric signal of a level corresponding to the amount of the infrared beam IR received thereby. This electric signal is, after having been amplified by an amplifier 22, inputted to a detector 23 from which a signal A proportional to the level of a pulse modulated light having an stray light component removed is outputted. This output signal A is discriminated as to whether or not it is equal to or lower than an intruder detecting level that is preset in a discriminating circuit 24. If it is equal to or lower than the intruder detecting level, a detection signal is outputted to a warning circuit 25 which in turn outputs an alarm signal to a security center 30 shown in FIG. 1 to advise the latter of the detection of an unauthorized intruder. The receiver base 19 shown in FIG. 1 has sensor circuit elements mounted thereon as will be described later, which sensor circuit elements are covered and protected by the receiver cover 20.

Alignment of respective optical axes of the beam projector and receiver 11 and 21 with each other is carried out while the projector and receiver covers 10 and 20 are removed from the respective bases 9 and 19 and, for this purpose, even when the projector cover 10 is removed the beam projecting unit 1 continues emitting the infrared beam IR. The optical alignment between the beam projector and receiver 11 and 21 is generally carried out by repeating a required number of times if so required, such a process of adjusting the optical axis of the beam projector 11 and subsequently adjusting the optical axis of the beam receiver 22.

In preparation for the optical alignment between the beam projector and receiving unit 1 and 2, an optical alignment adjusting mode has to be set in at the security center 30, and the projector and receiver covers 10 and 20 covering respectively the beam projector and receiver 11 and 21 have to be removed from the associated bases 9 and 19. Thereafter, using an optical sighting device (not shown) incorporated in the beam projecting unit 1, the beam projector 11 has to be oriented towards the beam receiver 22 with naked eyes so as to face towards the latter. When the projector cover 10 is removed to enable the optical axis of the beam projector 11 to be adjusted, a first switch 16 which may be either a mechanical type or a magnetic type is activated to allow a discriminative signal transmitting circuit 17 to output to a projector drive circuit 12 a discriminative signal B indicative of removal of the projector cover 10, which is, for example, a high frequency pulse signal of a waveform shown in FIG. 3B and which is of a frequency different from that of the infrared beam IR while the beam projecting unit 1 emits an infrared beam (IR+B) that is the infrared beam IR of a pulse waveform for detection of an unauthorized intruder superimposed with the discriminative signal B.

On the other hand, in the beam receiving unit 2, the discriminative signal B is separated by a detector 23 and, when the discriminative signal B is discriminated by a discriminative signal recognizing circuit 28, a notifying signal indicative of removal of the projector cover 10 from the beam projecting unit 1 is outputted and, accordingly, the beam receiving unit 2 can recognize that the beam projecting unit 1 is being adjusted as to its optical axis.

The optical axis adjustment of the beam projector 11 is carried out in the following manner. Specifically, after an optical axis adjusting signal transmitter 27 provided in the beam receiving unit 2 is connected with an optical axis adjusting signal receiver 14 in the beam projecting unit 1 either by means of a communication line or wireless, while the display of a level meter 26 of the beam receiving unit 2 has to be monitored by means of a level meter 15 connected with an optical axis adjusting signal receiver 14 of the beam projecting unit 1, the optical axis of the beam projector 11 in both a horizontal direction and a vertical direction has to be finely adjusted so that the level meter 15 can display a maximum reading.

On the side of the beam receiver 21, the optical axis of the beam receiver 11 in both a horizontal direction and a vertical direction has to be finely adjusted with the use of an optical sighting device (not shown), incorporated in the beam receiver 21, so that the level meter 15 can display a maximum reading.

It is to be noted that the various sensor circuit elements of the beam projecting unit 1 such as the beam projector 11, the projector drive circuit 12, the optical axis adjusting signal receiver 14, the level meter 15, the first switch 16 and the discriminative signal transmitting circuit 17 are fixedly mounted on the projector base 9 shown in FIG. 1, whereas the various sensor circuit element of the beam receiving unit 2 such as the beam receiver 21, the amplifier 22, the detector 23, the discriminating circuit 24, the warning circuit 25, the level meter 26, the optical axis adjusting signal transmitting circuit 27 and the discriminative signal recognizing circuit 28 are fixedly mounted on the receiver base 19 shown in FIG. 1.

After the optical axis adjustment, the projector and receiver covers 10 and 20 are mounted on the associated bases 9 and 10 to cover and protect the beam projector and receiver 11 and 21, respectively. Mounting of the projector and receiver covers 10 and 20 in this way automatically turns the first switch 16 off with the transmission of the discriminative signal B consequently halted. Then, a communication line 3 connecting between the optical axis adjusting signal transmitting element 27 and the optical axis adjusting signal receiver 14 is disconnected to bring the anti-thief security sensor assembly to be set in an unauthorized invader detecting mode.

According to the foregoing embodiment of the present invention, even when the projector cover 10 is removed for enabling the optical axis adjustment of the beam projector 11 to be performed, emission of the infrared beam IR does not interrupt and, therefore, without being pressed by the limited available length of time for the optical axis adjustment, a servicing person can continuously perform the optical axis adjustment. Accordingly, the work efficiency can be increased and the adjusting accuracy can also be increased.

On the other hand, in the beam receiving unit 2, since the beam receiving unit 2 can recognize that the optical axis adjustment of the beam projector 11 of the beam projecting unit 1 is taking place, there is no possibility that even if an notifying signal is generated in response to lowering of the level of the light received by the receiver 20 during the optical axis adjustment, passage of an unauthorized intruder may not be detected erroneously. Also, when in the unauthorized intruder detecting mode, the discriminative signal B is received and recognized by the beam receiving unit 2 upon removal of the projector cover 10 of the beam projecting unit 1 and, therefore, based on the discriminative signal B a notifying signal can be generated.

FIG. 4 illustrates a block circuit diagram of the anti-thief security sensor assembly according to a second preferred embodiment of the present invention. In this figure, component parts shown therein, but similar to those in the foregoing embodiment are designated by like reference numerals used in connection with the foregoing embodiment and the description of those similar component parts are not reiterated for the sake of brevity.

The anti-thief security sensor assembly according to the second embodiment shown in FIG. 4 differs from that, in place of the first switch 16 shown in FIG. 1, a second switch 18 adapted to be manually operated by a servicing person is provided. The second switch 18 outputs by a first operation the discriminative signal B from the discriminative signal transmitting circuit 17, and halts transmission of the discriminative signal B by a second operation.

According to the second embodiment, when the projector cover 10 is removed during the optical axis adjustment of the beam projector 11, the second switch 18 is to be manually turned on to transmit the infrared beam (IR+B), which is the infrared beam IR superimposed with the discriminative signal B. After completion of the optical axis adjustment of the beam projector 11, the projector cover 10 is mounted and the second switch 18 is then manually turned off to interrupt transmission of the discriminative signal B, whereby the anti-thief security sensor assembly can be set in the unauthorized intruder detecting mode. Accordingly, as is the case with the previously described first embodiment of the present invention, without being pressed by the limited available length of time for the optical axis adjustment, the servicing person can continuously perform the optical axis adjustment of the beam projector 11.

It is to be noted that although in any one of the foregoing embodiments of the present invention, the anti-thief security sensor assembly has been described wherein removal of the cover can be warned by transmitting the infrared beam superimposed with the discriminative signal to the beam receiving unit and then by allowing the beam receiving unit to detect the discriminative signal, arrangement may be made in which the discriminative signal can be transmitted separately from the infrared beam and received in the form of a wireless radio signal, or in which the discriminating signal can be transmitted and received by a electric wire that is connected only at the time of the optical axis adjustment.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. An anti-thief security sensor assembly including a beam projecting unit for emitting an infrared beam, and a beam receiving unit for receiving the infrared beam emitted from the beam projecting unit, wherein when a human body intercepts passage of the infrared beam traveling from the beam projecting unit towards the beam receiving unit, the human body can be detected, said assembly comprising:

a beam projecting unit including a first switch adapted to be activated when a cover protecting the beam projecting unit is removed and for outputting a discriminative signal descriptive of removal of such cover, and a transmitting circuit for transmitting the discriminative signal from the beam projecting unit to the beam receiving unit; and a beam receiving unit including a recognizing circuit for receiving the discriminative signal and outputting a notifying signal to notify the removal of the cover.

2. The anti-thief security sensor assembly as claimed in claim 1, wherein said transmitting circuit is operable to superimpose the discriminative signal on the infrared beam emitted from the beam projecting unit and the recognizing circuit is operable to discriminate the discriminative signal from the infrared beam received by the beam receiving unit.

3. The anti-thief security sensor assembly as claimed in claim 2, wherein the infrared beam is a pulse modulated light and said discriminative signal is a pulse signal having a frequency different from that of the infrared beam.

4. An anti-thief security sensor assembly including a beam projecting unit for emitting an infrared beam, and a beam receiving unit for receiving the infrared beam emitted from the beam projecting unit, wherein when a human body intercepts passage of the infrared beam traveling from the beam projecting unit towards the beam receiving unit, the human body can be detected, said assembly comprising:

a beam projecting unit including a second switch adapted to be manually operated to output to the beam projecting unit a discriminative signal indicative of a job of aligning respective optical axes of the beam projecting unit and receiving unit with each other being performed, and a transmitting circuit for transmitting the discriminative signal from the beam projecting unit to the beam receiving unit; and a beam receiving unit including a recognizing circuit for receiving the discriminative signal and outputting a notifying signal to notify the removal of the cover.

5. The anti-thief security sensor assembly as claimed in claim 4, wherein said transmitting circuit is operable to superimpose the discriminative signal on the infrared beam emitted from the beam projecting unit and the recognizing circuit is operable to discriminate the discriminative signal from the infrared beam received by the beam receiving unit.

6. The anti-thief security sensor assembly as claimed in claim 5, wherein the infrared beam is a pulse modulated light and said discriminative signal is a pulse signal having a frequency different from that of the infrared beam.

7. A security sensor assembly comprising:

a beam projecting unit for projecting a directional beam of radiation having a housing, a beam projector in the housing, a cover member removably connected to the housing to protect the beam projector, a first switch member operatively connected to the cover member, and a transmitting circuit operatively activated by the first switch when the cover member to transmit a discriminative signal representative of removal of the cover member; and a beam receiving unit having a recognizing circuit receiver for receiving the discriminative signal and outputting a notifying signal of the removal of the cover member.

8. The security system assembly of claim 7, wherein the beam projecting unit further includes a second switch member that can be activated manually to activate the transmitting circuit to provide the discriminative signal.

9. The security system assembly of claim 8, wherein the discriminative signal can be integrated with the transmission of the directional beam of radiation.

10. The security system assembly of claim 9, wherein the directional beam of radiation is pulse modulated and the discriminative signal is a pulse signal having a different frequency than the directional beam of radiation.

11. The security system assembly of claim 10, wherein the directional beam of radiation is an infrared beam.

* * * * *